United States Patent [19]

Dick et al.

[11] 4,108,559

[45] Aug. 22, 1978

[54] BALL POINT PEN BACK END CLOSURE

[75] Inventors: Franklin Dick; Peter H. Seckel, both of Upper Montclair, N.J.

[73] Assignee: Dart Industries Inc., Los Angeles, Calif.

[21] Appl. No.: 707,159

[22] Filed: Jul. 21, 1976

[51] Int. Cl.[2] ..... B43K 7/02

[52] U.S. Cl. ..... 401/217

[58] Field of Search ..... 401/217, 141, 142, 209, 401/199

[56] References Cited

U.S. PATENT DOCUMENTS

| | | | |
|---|---|---|---|
| 3,698,825 | 10/1972 | Sears et al. | 401/217 |
| 3,822,949 | 7/1974 | Dick | 401/217 |

FOREIGN PATENT DOCUMENTS

| | | | |
|---|---|---|---|
| 517,594 | 2/1953 | Belgium | 401/217 |

*Primary Examiner*—Stephen C. Pellegrino

*Attorney, Agent, or Firm*—Leigh B. Taylor

[57] ABSTRACT

A pen plug particularly useful in ballpoint pens as a stopper to prevent back leakage of ink from the ink reservoir of such pens and yet function to allow passage of air into the pen interior. Such plugs include a plurality of substantially continuous synthetic filaments such as cellulose acetate, natural fibrous threads and synthetic filaments or mixtures of differing synthetic filaments bundled, braided and preferably encased in a plastic sheath.

6 Claims, 6 Drawing Figures

2
3
3
10
11
12
14
16
16A
18
20
22
24
26

BALL POINT PEN BACK END CLOSURE

Conventional ballpoint pens include an ink or fluid reservoir from one end of which the typical applicator or writing tip protrudes. This tip, of course, is in contact with the ink and the opposite end of the reservoir is commonly open to the atmosphere so that air may enter the reservoir and displace the writing fluid as it is expelled from the writing tip. Ordinarily, the meniscus of the ink column or a follower prevents the ink from flowing back through the open end of the reservoir; however, if the pen is jarred violently or a break occurs in the ink film at the ballpoint, the ink may leak from the open back end of the reservoir. Leakage of this type is quite undesirable since it may soil not only the user's work product, but also his wearing apparel.

In attempting to alleviate this leakage, air-permeable plugs or stoppers of porous materials, such as sintered metal, urethane foams and treated felts or the like have been inserted in the reservoir back-end opening. These have usually been separated by an air space from the fluid and have relied on the theory that such materials will facilitate the ingress of air while preventing the back flow of ink beyond the stopper. In most such instances, positive obstruction of the ink is accomplished due to filling of the pores in the stopper and further seeping is arrested by capillary action or swelling of the stopper material.

Conventional ballpoint pens are, however, mass produced and the prior art back-end plugs frequently have not attained the degree of reliability that is required for such manufacturing techniques. In some instances, placement of stoppers in the reservoir is made difficult due to the size and unusual construction of the stopper, and this may result in an improper insertion and fit, thus creating a leaker. Neither is it uncommon for conventional stoppers to impair the flow of air into the reservoir so that the ink will not flow properly to the writing tip. In other situations of backflow past the stopper, the cause usually lies largely in the fact that the pores of the stopper are too large. On the other hand, in instances of insufficient ingress of air to produce proper writing action, the pores of the stopper are too small, either in the stopper material itself as initially formed, or as a result of its compression during installation in the reservoir.

The invention, upon which this invention improves, provides a back-end pen plug construction that is readily adaptable to high volume productivity because of the insertion and cut-off technique which may be employed in the manufacturing assembly process. This plug construction preferably includes a plastic sheath within which there is retained a bundle of synthetic filamentous material. Similarly, it may, on occasion, be advantageous to use several different synthetic fibers or cotton and synthetic fibers in these plugs to lend additional strength to the bundle for processing purposes. Further, the fibers that are being relied upon for strength will be uncrimped and unbulked whereas the sealing synthetic fiber may be crimped and bulked or uncrimped and unbulked.

The compression of these fibers one upon the other and fusion of the outermost fibers with the sheath eliminating any potential direct path between the plug ends through which ink might flow. Likewise, the compression fit between the exterior of the plug and the reservoir tends to completely seal this area so that in the event of pen failure, no leakage will be experienced around the plug perimeter. Accordingly, this back-end plug provides a reliable stopper means that may be used inside a separate ink cartridge intended for use in a pen or in the reservoir of a pen that is either directly filled or employs a cartridge.

However, the mentioned plug construction, with its longitudinally oriented fiber arrangement, has been found to present certain difficulties as the back-end plugs are cut to length. Because the fibers are longitudinally arranged and preferably unbonded except at the bundle periphery there is a tendency to "pull" certain of the fibers during the plug cutting operation. Thus the exposed plug end may exhibit a rough and uneven appearance that is esthetically unacceptable.

To alleviate this problem this invention contemplates breaking the overall back-end plug fiber bundle into a plurality of strands which are finish braided to produce the final plug interior. This arrangement essentially locks the fibers in place within their surrounding sheath, thus stabilizing same during processing and eliminating the mentioned problem.

With the foregoing more important features in mind and with such other features as may become apparent as this specification proceeds, the invention will be understood from the following description taken in conjunction with the accompanying drawings, wherein like characters of reference are used to designate like parts and wherein.

Figures 1, 2, 3, 4, 5, 6:
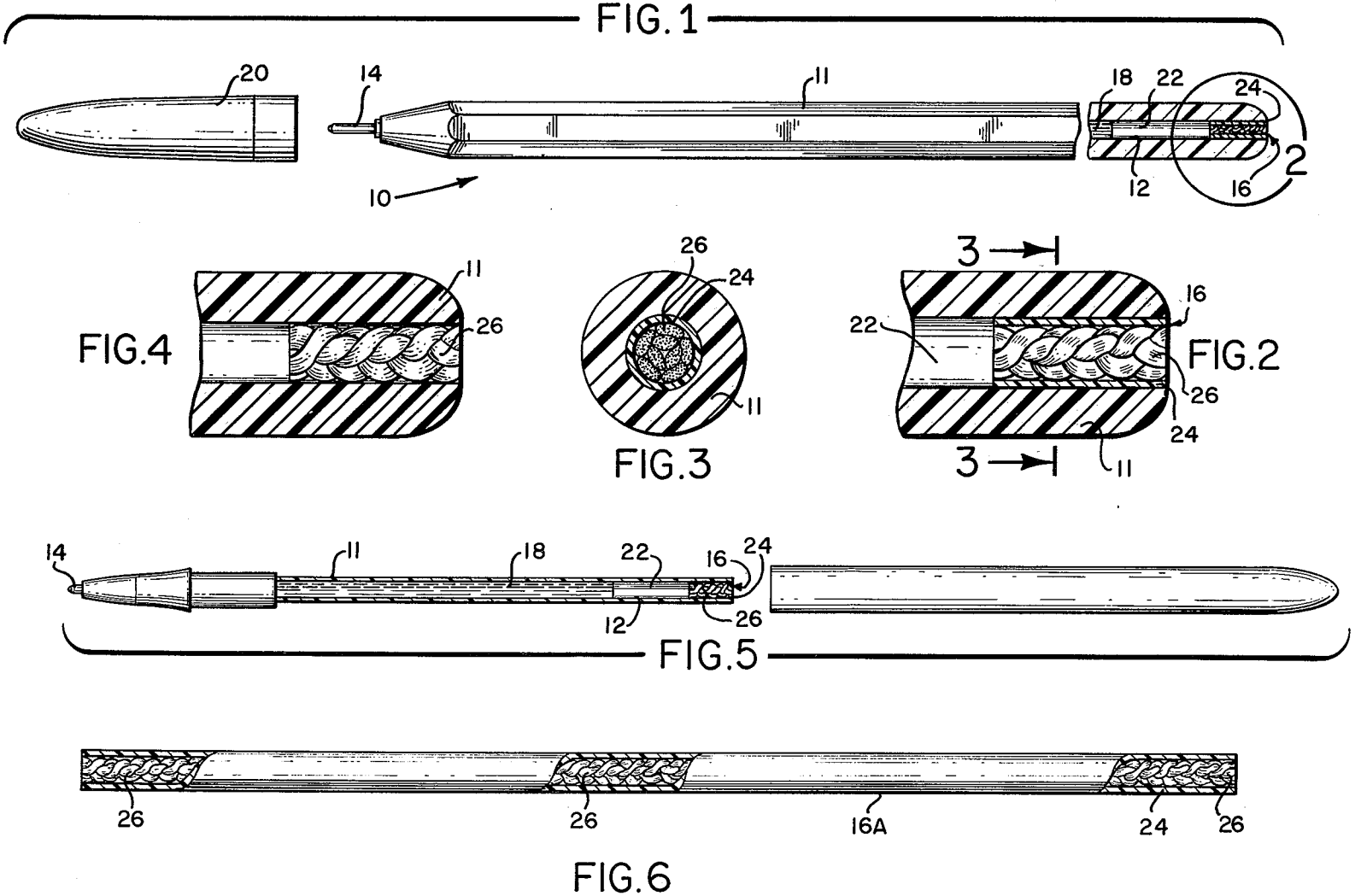
FIG. 1 is an exploded partially cross sectioned plan view of a typical ballpoint pen incorporating the air-permeable plug of this invention.
FIG. 2 is an enlarged cross section of the ballpoint pen of FIG. 1 showing a preferred form of the air-permeable back-end plug of this invention.
FIG. 3 is a transverse cross section taken along line 3—3 of FIG. 2.
FIG. 4 is an enlarged cross section of a ballpoint pen similar to that shown in FIGS. 1 and 2.
FIG. 5 is also an exploded partially cross-sectioned plan view of another typical ballpoint pen incorporating the air-permeable plug of this invention.
FIG. 6 is an enlarged partially cross-sectioned plan view of an extended length of air-permeable plug material prior to incorporation in a ballpoint pen or similar writing instrument.

Referring now to the accompanying drawings in detail, and more particularly to FIG. 1, the reference numeral 10 designates a typical ballpoint pen. This pen, of course, further includes a barrel member 11 interior of which is a fluid reservoir 12, a writing tip or applicator 14, and a stopper or back-end plug 16 which is air-permeable yet forms a positive obstruction to writing fluids. Thus, the stopper 16 will permit the ingress of air to displace the outgoing ink at the writing tip and yet will prevent the back flow of ink 18 out of the reservoir 12.

Similarly, as is common to such pens, there is provided a cap member 20 to shield the tip 14 when the pen is not in use.

The stopper or back-end plug 16 is preferably a sheathed bundle of fibers and is more fully described hereinbelow. Such stopper, however, is positioned at the rear of the fluid reservoir 12 in a typical press type fit. It should also be obvious from FIG. 1 that this form of stopper may be equally effectively used in the back-end portion of other ballpoint pen constructions or similar writing fluid cartridges, such as is illustrated in FIG. 5 wherein like parts are represented by the same reference numerals. Similarly, two or more stoppers of this type may be employed in series and when several are so used, they may either abut or be spaced from one another. In any event, an air space 22 should be retained between the stopper or stoppers and the writing fluid or ink 18.

FIGS. 2 and 3 further and more explicitly illustrate a preferred form of the back-end plug 16 of this invention wherein such incorporates a sheath 24 that surrounds and retains the filamentous material 26.

Furthermore, FIG. 6 illustrates the intermediate tubular product 16A from which the air-permeable plugs 16 are severed during the pen manufacturing operation. As mentioned each of these plugs is preferably comprised of an uncrimped, unbulked, braided bundle of filamentous material 26 surrounded by a substantailly continuous sheath 24.

FIG. 4 simply represents an embodiment of the invention wherein the braided bundle of filamentous material 26 is supported within barrel member 11 without the incorporation of sheath 24. Likewise, in the FIG. 5 embodiment the surrounding sheath 26 in effect also functions in the capacity of the member 11 of FIG. 1 in that such sheath forms the fluid reservoir 12.

Note in particular that these arrangements lend some flexibility not only to the plug dimensions, but also to fiber specifications which may be employed. Thus, several variations may be effectively impervious to ink, yet pervious to air. It is preferred, however, that the major portion of the fibrous bundle 26 be of a continuous low-twist, cellulose acetate material having between about 3000 and 25,000 total denier. Alternatively, however, the cellulose acetate fibers may be crimped and bulked. Likewise, if desired, the bundle may be treated with adhesives or like materials to produce a more rigid package. It may also be desirable to incorporate other synthetic fibers, for example, polyester materials into the bundle in order to strengthen the filamentous mass for processing purposes. Preferably such added fibers would be uncrimped and would be positioned on the periphery of the bundle adjacent the sheath 24. Further, it is considered practical to use up to 40% of the total bundle of polyester material in these applications.

It is also conceived that an intermixture of natural (mercerized cotton) and synthetic fibers, for example, cellulose acetate, may also provide an effective stopper. In this instance, the cotton will lend strength to the bundle as it is being processed into plug form and may include as many as 50 such threads.

In each instance, however, the sheath 24 will preferably have an inside diameter of between about 0.025 inch and 0.250 inch and be made of a suitable plastic such as polypropylene or the like. Plug material 16A therefore may be manufactured by extruding the sheath over a suitably arranged filamentous bundle typical of which is 8 strands of 450 ends or filaments, each filament preferably having a two (2) denier weight.

Accordingly, the approximate total weight per strand is 900 denier and the braided plug is nominally 7200 denier. It should be further noted that because of the braided construction the outer diameter and degree of compaction of the filamentous bundle can also be more easily controlled simply by varying the tension applied to the braid and/or the strands as same is woven.

It should also be obvious that the embodiment of FIGS. 1–3 has the back-end plug 16 press-fit into the pen barrel 11 such that it seals any possible fluid passageway between the outer surface of sheath 24 and the bore surface forming the fluid reservoir. This then provides the user with a more reliable obstruction member in that positioning of the stopper in the reservoir back-end opening is not critical to produce a good seal. Similarly, the intermediate product 16A is one which lends itself to ease of handling for the pen manufacturer. Thus, it should be obvious from the above that an improved stopper construction is here disclosed which in all respects represents a substantial advance of the prior art products and techniques.

The other FIGS. 4 and 5 embodiments are, however, equally suitable for the purpose intended and in some respects may be preferred depending upon the manufacturer's capabilities and preferences.

In operation and so long as the ink remains out of contact with the plug, air may find its way into the interior of the pen barrel and thereby displace the ink 18. Upon pen failure, however, the ink may flow to the rear of the barrel 11 and, of course, begin to permeate the plug. The dense synthetic fiber bundle and particularly the cellulose acetate will attenuate this flow and thereby begin a plugging action within the bundle. Additionally, contact of the acetate with typical pen inks produces a swelling action which further compresses the bundle and effectively produces a positive blockage to further flow as well as the ingress of air.

While in the foregoing there have been described and shown the preferred embodiments of the invention, various modifications may become apparent to those skilled in the art to which the invention relates. Accordingly, it is not desired to limit the invention to this disclosure and various modifications and equivalents may be resorted to, falling within the spirit and scope of the invention as claimed.

I claim:

1. An air-permeable plug adapted to act as a positive obstruction to writing fluids typically used in writing implements and comprising a substantially continuous sheath having an inside diameter of between about 0.025 and 0.250 inches and a low twist substantially continuous braided filamentous material having a total denier of between about 3000 and 25,000 encased in said sheath and further characterized by its perviousness to air and its imperviousness to writing fluids when exposed to and contacted therewith.

2. A plug according to claim 1 wherein said filamentous material is uncrimped and unbulked cellulose acetate.

3. A plug according to claim 1 wherein said sheath is between about 0.025 and 0.250 inches in diameter and is of a polypropylene construction.

4. A writing implement including in combination a fluid reservoir containing an ink supply, an applicator in contact with said ink supply and a back-end plug means comprised of a braided bundle of filamentous material having a total denier of between about 3000 and 25,000, said means being further adapted to permit passage of atmospheric air while preventing backflow therethrough of the content of the reservoir.

5. A writing implement according to claim 4 wherein said plug means also includes a substantially continuous sheath having an inside diameter of between about 0.025 and 0.250 inches, said sheath encasing and retaining the bundle of filaments and being tightly positioned in an opening to said reservoir.

6. A writing implement according to claim 4 wherein said sheath is of a polypropylene construction.

* * * * *